US009140526B1

(12) United States Patent
Calvert

(10) Patent No.: US 9,140,526 B1
(45) Date of Patent: Sep. 22, 2015

(54) ROBOT IMMOBILIZER AND SIGNAL INTERFERENCE FOAM

(71) Applicant: RISI Associates, Trustee for Robot Immobilizer and Signal Interference Foam CRT Trust, Manassas, VA (US)

(72) Inventor: S. Mill Calvert, Manassas, VA (US)

(73) Assignee: RISI Associates, Trustee for Robot Immobilizer and Signal Interference Foam CRT Trust, Manassas, VA (US)

( * ) Notice: Subject to any disclaimer, the term of this patent is extended or adjusted under 35 U.S.C. 154(b) by 0 days.

(21) Appl. No.: 14/341,779

(22) Filed: Jul. 26, 2014

(51) Int. Cl.
*F41H 11/00* (2006.01)
*F41H 13/00* (2006.01)
*F41H 9/00* (2006.01)

(52) U.S. Cl.
CPC ..... *F41H 11/00* (2013.01); *F41H 9/00* (2013.01); *F41H 13/00* (2013.01)

(58) Field of Classification Search
CPC ..... F41H 9/00; F41H 911/02
See application file for complete search history.

(56) References Cited

U.S. PATENT DOCUMENTS 4,069,684 A 1/1978 Wilson
4,071,195 A 1/1978 Kuhns et al.
4,196,668 A * 4/1980 Morlock et al. ..... 102/473
4,550,544 A 11/1985 Thoeny
4,913,978 A 4/1990 Klotz et al.
5,011,330 A 4/1991 Kittle et al.
5,194,687 A * 3/1993 Garfinkle ..... 89/1.11
5,965,851 A * 10/1999 Herreman et al. ..... 181/200
7,204,817 B1 4/2007 Toronto et al.
7,511,970 B2 3/2009 Justason et al.
7,717,357 B2 * 5/2010 Gantenbein et al. ..... 239/13
8,375,837 B2 * 2/2013 Goossen et al. ..... 89/1.11

OTHER PUBLICATIONS

Xiangcheng Luo, et al., Electromagnetic interference shielding using continuous carbon-fiber carbon-matrix and polymer-matrix composites, Composites: Part B 30 (1999) 227-231, Elsevier, Composite Materials Research Laboratory, State University of New York at Buffalo, Buffalo, NY 14260-4400, USA.

* cited by examiner

*Primary Examiner* — Nathan T Leong
(74) *Attorney, Agent, or Firm* — Louis Ventre, Jr.

(57) ABSTRACT

A method is performed to immobilize and radio-isolate a robotic device. The method includes steps of storing ingredients that when mixed together create a foam that hardens to 50 percent to 75 percent of ultimate physical characteristics in less than 90 seconds after being sprayed; containing metal particulates for mixing prior to spraying; piping the ingredients and metal particulates to a nozzle so that they mix together to form a metal-foam mixture when sprayed from the nozzle; and spraying the metal-foam mixture on the robotic device. An optional spray component is liquid glue that is piped to mix with the foam ingredients and metal particulates prior to spraying.

1 Claim, 2 Drawing Sheets

ROBOT IMMOBILIZER AND SIGNAL INTERFERENCE FOAM

TECHNICAL FIELD

In the field of compositions, a method of coating results in robotic countermeasures when implemented against a robotic device.

BACKGROUND ART

Fast-setting, expandable, organic spray foams are used in the pipeline industry to support buried pipelines while filling the void between the pipeline and the trench wall. These foams are employed partly because they offer rapid expansion, corresponding rapid stiffening to conform to the pipe, provide vertical support and resist lateral movement of the pipeline.

Ever since the days of the industrial revolution, mankind has sought to develop new techniques that would enable machines to do more and more of the work. In today's industrial economy you have entire manufacturing factories where robotic machines perform a large percentage of the operations.

The modern day military and law enforcement of the world want in on this trend and they are spending billions of dollars on developing robotic systems. There are all types of flying, crawling, driving, slithering, rolling, walking or running like a man or animal robotic systems.

Available robots are designed to do some aspects of a job that are better or safer than a soldier or police officer could do. Some are bullet proof, explosion proof, fire proof, can kill, and can remotely return valuable intelligence. Some robots have autonomous capabilities, but most of these robotic systems are controlled by a human being: a controller that is in a safe, remote location. That location might be behind local cover or it might be in a control room half way around the world. Future warfare and police actions are often the subject of speculation in a Hollywood movie as robots are tasked to fight and kill both humans and other robots.

SUMMARY OF INVENTION

A method is performed to immobilize and radio-isolate a robotic device. The method includes steps of storing ingredients that when mixed together create a foam that hardens to 50 percent to 75 percent of ultimate physical characteristics in less than 90 seconds after the ingredients creating the foam have been sprayed; containing metal particulates for mixing prior to spraying; piping the ingredients and metal particulates to a nozzle so that they mix together to form a metal-foam mixture when sprayed from the nozzle; and spraying the metal-foam mixture on the robotic device. An optional spray component is liquid glue that is piped to mix with the foam ingredients and metal particulates prior to spraying.

Technical Problem

If a country or their military had a simple way to stop robotic machines, such a method could provide a military advantage. If specialized operations soldiers could cheaply and easily immobilize weaponized robots, such an ability could be an effective robot countermeasure to protect their lives and improve mission success.

If a country or their military had a simple way to freeze a robotic weapon system and also disrupt radio communication with it at the same time, the robotic weapon system would be of no more use or value than a disabled tank or an old flattened, rusted car sitting at the metal scrap yard.

Solution to Problem

The robot immobilizer and signal interference foam now makes it easy to stop and eliminate robotic machines. The robot immobilizer and signal interference foam attacks the Achilles heel in the design of all of the billions of dollars of robotic systems. This Achilles heel is the mechanical movement of linkages and the sending and receiving of control signals necessary for human control of the robotic system. If none of the parts associated with mobility or weapons targeting are able to move and control signals are interrupted, this very expensive robot is of no more use then the frozen, rusted tin man in the woods in the Wizard of Oz.

The robot immobilizer and signal interference foam uses a special type of signal blocking expansion foam that preferably also includes fast setting glue. The robot immobilizer and signal interference foam is sprayed under pressure onto a nearby robot machine. As the foam covers the robot, it expands and infiltrates into every crack and crevice on the machine and as it solidifies and dries, the robot no longer has any parts that can move. It is like it has been placed inside a hardened cocoon.

The robot immobilizer and signal interference foam also contains signal blocking material so communication and sight with the controller is lost. The only thing the controller can tell is that his computer screen went blank and the robot is not responding. A robot that a defense contractor may have charged a million dollars to build can now be made worthless at low cost and with easily delivered countermeasures.

There are many different ways that the robot immobilizer and signal interference foam can be projected onto the enemy's robots. It could be a pressurized gun or nozzle, a spray can, a robot immobilizer and signal interference foam projectile, a drone that sprays it on, etc.

Advantageous Effects of Invention

The military side that has robot immobilizer and signal interference foam cannot only stop the robots, but they can then capture, store and modify them for their own use or for reverse engineering.

It has always been said that the simplest solution is usually the best solution. The robot immobilizer and signal interference foam is a solution that will stop the great dangers that this onslaught of robots can bring to mankind and once again put humans in charge of their destiny.

Stopping any onslaught of militarized robotic machines would be a positive step for both man and mankind.

BRIEF DESCRIPTION OF DRAWINGS

The drawings illustrate preferred embodiments of the robot immobilizer and signal interference foam according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate an embodiment of the present invention. The drawings and the preferred embodiment of the invention are presented with the understanding that the present invention is susceptible of embodiments in many different forms and, therefore, other embodiments may be utilized and structural, and operational changes may be made, without departing from the scope of the present invention.

Figure 1:
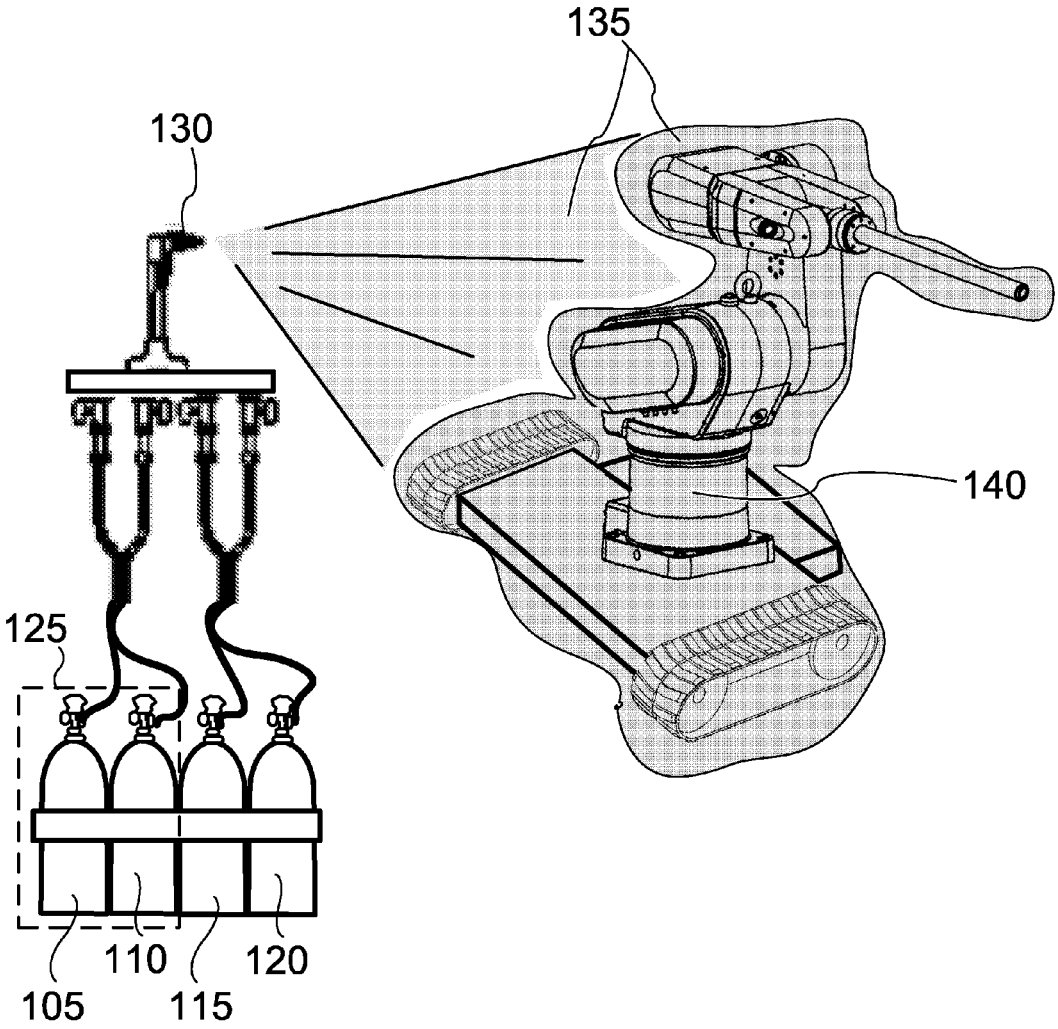
FIG. 1 is an illustration showing the method resulting in a robotic device covered in a metal-foam mixture.
Figure 2:
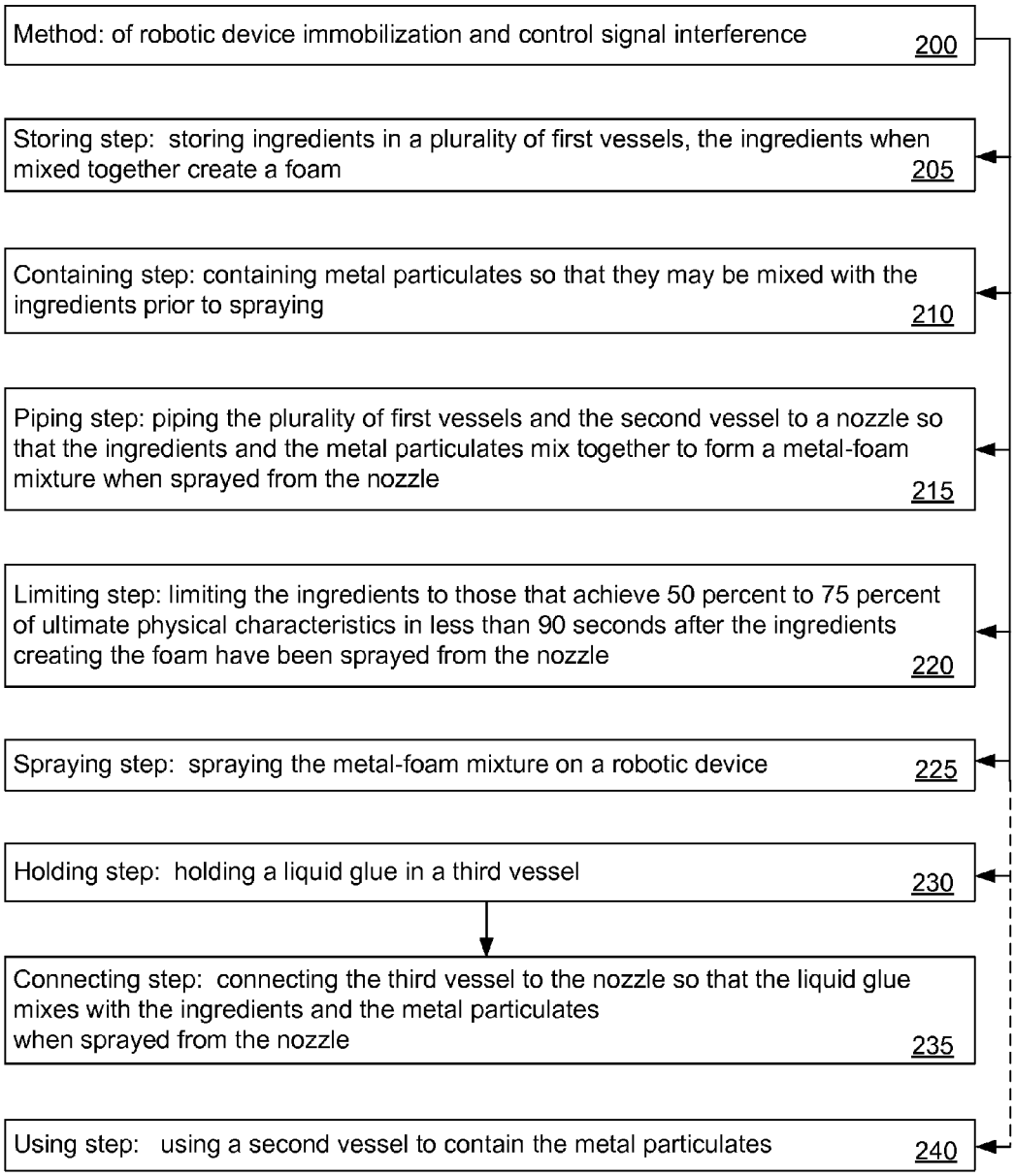
FIG. 2 is a block diagram illustrating the method steps.

Reference is made to FIG. 1 for the components and to FIG. 2 for the steps in the method.

The process or method (200) is one of robotic device (140) immobilization and control signal interference. The method (200) includes: a storing step (205); a containing step (210); a piping step (215); a limiting step (220); a spraying step (225); a holding step (230); and a connecting step (235).

The storing step (205) includes storing ingredients that when mixed together create a foam. The ingredients are preferably in a plurality of first vessels (125), which in one embodiment are pressurized tanks holding the ingredients. In other embodiments, a separate pressurized gas tank is used to move and mix the ingredients together and then subsequently spray the mixture. The plurality of first vessels (125) is shown within the dashed enclosure in FIG. 1. The plurality of first vessels (125), as shown in FIG. 1, includes a first tank (105) and second tank (110). While two such tanks are shown, there may be others as needed to create the foam.

Spray foam is often distinguished from pour foam in that spray foam is catalyzed to harden much more rapidly even if the basic foam constituents are similar. Spray foams are preferably expandable, fast-setting foam materials, which cure or achieve 50% to 75% of their ultimate physical characteristics, that is their hardened strength, in less than 90 seconds after the foam ingredients have been mixed; more preferably in less than about 30 seconds after the foam ingredients have been mixed; and even more preferably in less than about 10 seconds after the foam ingredients have been mixed.

Due to the rapidity with which spray foams react, the ingredients are rapidly brought together in the mixing chamber of a pressurized spray apparatus and there mixed before being expelled therefrom as a spray under pressure. Since the ingredients are formulated to rapidly react, the foaming reaction is initiated immediately upon their introduction in the mixing chamber and commences while being expelled as a spray toward the area of deposition. However, the majority of foaming of the materials occurs after it has been deposited as a layer on the robot to be seized up and signal isolated.

The spray foam may be of any suitable spray type; for example, a conventional two component foam includes isocyanate and a polyol mixture mixed with a suitable catalyst and blown with FREON or other propellant. This exemplary foam is characterized in part by noticeable expansion immediately prior to setting. This exemplary expandable foam results primarily from the chemical reaction of the two identified components when mixed prior to spraying. The expanded foam product sprayed from the nozzle (130) often has a volume 20 to 30 times the original volume of the foam components, so that a small set of hand carry-able tanks will often be sufficient for one application. The isocyanate and polyol ingredients of this exemplary expandable and fast-setting spray foam are commercially available.

The foam is preferably sprayed under pressures of about 800-1100 psi from a two-component, self-cleaning nozzle or gun with a capacity of about 15 pounds per minute, which also is commercially available. The best performance is attained when the foam is sprayed in ambient temperatures not less than 40 degrees Fahrenheit or 4.4.degrees Centigrade.

The containing step (210) includes containing metal particulates, also referred to as metal particles, so that they may be mixed with the ingredients prior to spraying. This containing step (210) may be supplemented by containing metal particulates in a second vessel (115) and in this case there is an optional added using step (240) that includes using a second vessel (115) to contain the metal particulates. Alternatively, the containing step (210) may be performed by containing metal particulates as a mixture with one of the ingredients of the foam in the first tank (105) or the second tank (110).

When contained in a second vessel (115), the metal particulates are of a size that promotes their conveyance as an aerosol for mixture with the ingredients for creating a metal-foam mixture (135). While smaller or larger metal particulates may be used, the finer the particulate, the lower the necessary flow rate of carrier gas that is needed to aerosolize them for lifting out of the second vessel (115) and mixing them with foam ingredients immediately prior to spraying the metal-foam mixture (135).

When the metal particulates are contained as a mixture with one of the ingredients for the foam or simply as a liquid-particulate mix, the smaller the particulate, the better for resisting gravitational separation and retaining a homogenous mixture upon being shaken prior to spraying.

As an example for either containing alternative, ultrafine spherical aluminum oxide particles may be used each having geometric mean diameters ranging between 0.01 and 0.06 micrometers. Another example of metal particulates is tiny spheres coated with carbonyl iron or ferrite, which are commonly used in radar-absorbent material.

Electrically conducting metal particulates are preferred as these generate greater electromagnetic interference against the transmission of any electromagnet signals to or from the robot once covered by the metal-foam mixture (135). While even small amounts of metal particulates (e.g. <1% by weight) will change and disrupt an antenna's signal transmission characteristics on the robotic device (140), the greater the concentration of metal particles within the metal-foam mixture (135), the greater will be the resulting signal disruption or prevention performance of the metal-foam mixture (135) on the robotic device (140). A concentration of 5% to 50% metal by weight in the metal-foam mixture (135) is considered preferable, but larger or smaller concentrations may be used according to the anticipated application.

The piping step (215) includes piping the plurality of first vessels (125) and the second vessel (115) to a nozzle (130) so that the ingredients and the metal particulates mix together to form a metal-foam mixture (135) when sprayed from the nozzle (130).

The limiting step (220) specifies limiting the ingredients to achieve 50% to 75% of ultimate physical characteristics in less than 90 seconds after the ingredients creating the foam have been sprayed from the nozzle (130). The specified time of less than 90 seconds is intended as a rough parameter to capture the most practical foams for this application assuming that the faster the robotic device (140) is immobilized, the better for the person seeking to stop and radio-isolate the robotic device (140). As noted above, foams are available that harden to the specified level in as fast as 10 seconds.

The spraying step (225) includes spraying the metal-foam mixture (135) on the robotic device (140). Once the ingredients making the foam are mixed with the metal particulates, the mixture is then sprayed from the nozzle (130) onto the robotic device (140).

The holding step (230), which is optional, includes holding liquid glue in a third vessel (120). The liquid glue is preferably a super glue that hardens quickly. Such glues are commercially available with the ability to cure in a few seconds to several minutes. The faster setting glues are preferable because they enhance the operability of the metal-foam mixture (135) to seize-up the robotic device (140). Examples are epoxies; polyurethanes; silicones; and cyanoacrylates. Additionally, two component epoxy glues may be used which could necessitate holding the epoxy glue components in separate dispenser bottles.

The connecting step (235), which is performed when the holding step (230) is implemented, includes connecting the third vessel (120) to the nozzle so that the liquid glue mixes with the ingredients and the metal particulates when sprayed from the nozzle (130).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the defense industry.

What is claimed is:

1. A method of robotic device immobilization and control signal interference comprising the steps of:

providing a vessel comprising an isocyanate, providing a second vessel comprising a polyol, providing a third vessel comprising metal particulates, providing a fourth vessel holding a liquid glue selected from the group consisting of epoxies, silicones, and cyanoacrylates;

piping the isocyanate from the first vessel, the polyol from the second vessel, and the metal particulates from the third vessel to a nozzle so that the isocyanate, polyol, and metal particulates mix together at the nozzle to form a metal foam mixture when sprayed from the nozzle;

connecting the fourth vessel comprising the liquid glue to the nozzle so that the liquid glue mixes with the isocyanate, polyol, and metal particulates when sprayed from the nozzle; and spraying the metal-foam mixture and the liquid glue onto the robotic device so as to immobilize the robotic device and to interfere with control signals to the robotic device.

* * * * *